United States Patent [19]

Baburin et al.

[11] 4,217,169

[45] Aug. 12, 1980

[54] METHOD OF MANUFACTURING FIBROUS SHEET MATERIAL

[76] Inventors: Sergei V. Baburin, poselok Pravdinsky, ulitsa Zhdanova, 19, kv. 26; Vladimir A. Gorbushin, poselok Khotkovo, Turisticheskaya ulitsa, 13, kv. 19; Alexandr P. Muraviev; Valery N. Nepein, both of poselok Pravdinsky, Institutsky proezd, 1, all of Moskovskaya oblast; Mikhail V. Frolov, Varshavskoe shosse, 16, kv. 235, Moscow; Sergei A. Aizenberg, ulitsa Dmitrova, 11/67, kv. 136, Leningrad; Evgeny H. Golovko, Krasnoputilovskaya ulitsa, 28/29, kv. 58, Leningrad; Alexandr F. Kamenev, Bukharestskaya ulitsa, 7, kv. 232, Leningrad; Igor A. Sergeev, prospekt Stachek, 27, kv. 8, Leningrad, all of U.S.S.R.

[21] Appl. No.: 956,445

[22] Filed: Nov. 1, 1978

Related U.S. Application Data

[63] Continuation of Ser. No. 784,595, Apr. 4, 1977, abandoned, which is a continuation of Ser. No. 640,341, Dec. 12, 1975, abandoned.

[51] Int. Cl.[2] ..... D21D 3/00

[52] U.S. Cl. ..... 162/100; 162/201; 264/121

[58] Field of Search ..... 162/201, 100, 26, 13, 162/20; 264/121

[56] References Cited

U.S. PATENT DOCUMENTS

| | | | |
|---|---|---|---|
| 3,371,137 | 2/1968 | Asplund | 264/121 |
| 3,382,140 | 5/1968 | Henderson et al. | 162/26 |
| 3,446,699 | 5/1969 | Asplund et al. | 162/26 |

*Primary Examiner*—S. Leon Bashore
*Assistant Examiner*—Peter Chin
*Attorney, Agent, or Firm*—Robert E. Burns; Emmanuel J. Lobato; Bruce L. Adams

[57] ABSTRACT

A distinguishing feature of the method lies in that the moist fibrous raw material is constituted by a suspension of a fibrous material with a fibre concentration of 5–30 wt. %; said suspension is heated before dispersion to 102°–145° under a pressure of 1.1–4.0 atm abs and fed in the form of a stream into a moulding chamber where pressure in the stream is sharply reduced to 0.8–1.0 atm abs in the course of $10^{-1}$–$10^{-3}$ seconds.

1 Claim, No Drawings

METHOD OF MANUFACTURING FIBROUS SHEET MATERIAL

This is a continuation of application Ser. No. 784,595, filed Apr. 4, 1977 which is a Cont. of Ser. No. 640,341 filed Dec. 12, 1975 both abandoned.

BACKGROUND OF THE INVENTION

The present invention relates to the manufacture of fibrous sheet materials such as paper, cardboard, non-woven materials and more specifically it relates to the method of their manufacture.

Known in the art is an aerodynamic method of manufacturing fibrous materials consisting in that the fibrous raw material with an absolute moisture content of 5 to 100% and over of the weight of absolutely dry fibres which amounts to 95–50% and less in terms of concentration of fibres in the mass is preliminarily dispersed into individual fibres which are introduced into a stream of air for producing an air-material mixture in the form a directional flow delivered onto the moving screen of a moulding chamber.

Then the fibres are distributed over the screen by mechanical atomization of the mixture. The fibrous material is moulded on the moving screen by settling the fibres from the air-material mixture under the effect of pressure difference above and under the screen.

After producing a uniform layer of the fibrous material on the moving screen, said layer is mechanically compacted. Then the compacted material is dried and finished.

Owing to a high concentration of the source fibrous material (95–50%) the known method fails to generate the required amount of stream for dispersing the compacted fibre clots in the process of conveying the air-material mixture into the moulding chamber. Hence, the known method does not ensure a high degree of dispersion and distribution of fibres in the stream. This disadvantage in turn impairs the quality of the finished fibrous material which is characterized by an insufficiently uniform distribution of fibres and, as a consequence, by a low tensile strength. This also leads to a low speed of material moulding, a low output of the production equipment and a limited number of manufactured products. Thus, the known method can be utilized for manufacturing cardboard only.

There have been attempts made to eliminate the aforesaid disadvantages. A method has been envolved which has raised the uniformity of distribution fibres in the manufactured sheet material and increased its tensile strength. The source material in this method has been wood pulp subjected to mechanical and thermal treatment at 100° C. and higher to a moisture content of 30% and above (concentration of fibres in the mass being 70% and less).

The mass with the above-specified moisture content is distributed in a stream of gas thus producing an air-material mixture which is then directed into a moulding chamber and moulded similarly to the method described above.

In our opinion, the thermal treatment of the fibrous raw material in the above-described method equalizes the variations in the wetness of fibres in the moulding chamber which has a positive effect on the more uniform distribution of fibres in the chamber and in the finished fibrous sheet material. This in turn improves somewhat the tensile strength of the material.

However, in view of a relatively low wetness of the fibrous raw material this method is not quite efficient for producing fibrous materials with a high tensile strength and obtaining a high moulding speed.

Besides, both methods described above are rather complicated since they involve a number of individual successive operations such as dispersing the fibres, forming an air-material mixture and distributing the fibres in said mixture.

SUMMARY OF THE INVENTION

An object of the present invention lies in providing a method of manufacturing a fibrous sheet material which would ensure a high moulding speed and a wide number of finished materials characterized by a high tensile strength and a low cost.

This object is accomplished by providing a method of manufacturing a fibrous sheet material from a moist fibrous raw material by dispersing it, forming an air-material mixture flowing in a stream into a moulding chamber, distributing the fibres in the chamber and moulding the sheet material on the moving screen of the moulding chamber by settling fibres from the air-material mixture at a pressure difference above and under the screen followed by mechanical compaction, drying and finishing wherein, according to the invention, the moist fibrous raw material is constituted by a suspension of the fibrous material with a concentration of fibres varying from 5 to 30 wt.-%, the suspension is heated before dispersion to 102°–145° C. under a pressure of 1.1–4.0 atm abs and delivered into a moulding chamber where pressure in the stream is sharply reduced in the course of $10^{-1}$–$10^{-3}$ s down to 0.8–1.0 atm abs which ensures dispersion of the fibres in the produced steam-air medium with simultaneous formation of an air-material mixture and uniform distribution of fibres in said mixture.

DESCRIPTION OF THE PREFERRED EMBODIMENTS

The essence of the invention lies in the following.

The use of the suspension of a fibrous material with the concentration of fibres varying from 5 to 30% ensures such an amount of moisture in the moulded sheet material which is necessary for creating hydrogen bonds in the process of its drying, said bonds raising the tensile strength of the fibrous material.

The attainment of high strength of the finished fibrous material makes it possible to dispense with the use of binders, both synthetic and certain natural binders such as casein, starch, etc. which reduces the cost of the finished products.

The heating of the suspension of the fibrous material with the concentration of fibres varying from 5 to 30 wt.-% to 102°–145° C. allows building up a pressure of 1.1–4.0 atm abs in said suspension. This pressure is sufficient for conveying the fibrous mass towards the moulding chamber.

A sharp reduction of pressure from 1.1–4.0 atm abs to 0.8–1.0 atm abs increases the active surface of the fibres thereby increasing the moulding speed of the material.

This is accompanied by a sharp expansion of steam in the fibrous suspension contained in the moulding chamber; this causes dispersion of the suspension clots into individual fibres and their uniform distribution in the moulding chamber with simultaneous formation of an air-material mixture.

As a result, it has become possible to combine such operations as dispersion of the fibrous material into individual fibres, formation of an air-material mixture and uniform distribution of fibres in the chamber.

The combination of these operations at the material moulding stage simplifies considerably the manufacture of the fibrous material and ensures efficient control of the manufacturing operations.

To make the essence of the invention more apparent it will now be described by way of examples.

EXAMPLE 1

For manufacturing cardboard, the fibrous suspension of bleached sulphite cellulose with a concentration of 5% and a freeness of 90° according to Schopper-Riegler has been heated by steam at a temperature of 142° C. under a pressure of 4 atm abs to the state of equilibrium of moisture content between the fibrous suspension and steam in the closed volume of the heating chamber.

The heated fibrous suspension has been delivered in a stream of air and steam into a moulding chamber and the steam pressure has been sharply reduced from 4 atm abs to 1 atm abs which led to dispersion of the fibrous suspension in the steam-air medium, formation of an air-material mixture and uniform distribution of fibres in said mixture. Then the fibres have been settled on a moving moulding screen from the steam-air mixture of bleached sulphite cellulose under a pressure difference of 920 mm $H_2O$ created above and under the moving screen. The moulded moist sheet of cardboard has been dried through contact with a heated surface. The produced cardboard has been characterized by the following physical and mechanical properties: mass per 1 $m^2$–240 g; breaking length—3500 m; density—0.63 g/$cm^3$;

EXAMPLE 2

For manufacturing cardboard, the fibrous suspension of waste paper with a fibre concentration of 10% and a freeness of 45° according to Schopper-Riegler has been heated with steam at 120° under a pressure of 2 atm abs to the state of equilibrium of moisture content between the fibrous suspension and steam in the closed volume of the heating chamber. The heated fibrous suspension has been delivered also in a an air-steam stream into a moulding chamber and the steam pressure has been sharply reduced from 2 atm abs to 1 atm abs. The following operations have been the same as in Example 1. The produced carboard has had the following physical and mechanical properties: mass per 1 $m^2$–170 g; breaking length—2150 m, density—0.50 g/$cm^3$.

EXAMPLE 3

For manufacturing wrapping paper, the fibrous suspension of brown wood pulp with a fibre concentration of 18% and a freeness of 65° according to Schopper-Riegler has been heated by steam at 130° C. under a pressure of 2.8 atm abs to the state of equilibrium of moisture content between the fibrous suspension and steam in the closed volume of the heating chamber. The heated fibrous suspension has been delivered in a stream of air and steam into a moulding chamber and the steam pressure has been sharply reduced from 2.8 atm abs to 1 atm abs. The following operations have been the same as in Example 1. The physical and mechanical properties of the produced wrapping paper have been as follows: mass per 1 $m^2$–70 g; breaking length—3000 m; density—0.48 g/$cm^3$.

EXAMPLE 4

For manufacturing cardboard, the fibrous suspension of bleached sulphite cellulose with a fibre concentration of 30% and a freeness of 90° according to Schopper-Riegler has been heated by steam at 142° C. under a pressure of 4 atm abs to the state of equilibrium of moisture content between the fibrous suspension and steam in the closed volume of the heating chamber. The heated fibrous suspension has been delivered also in a steam of air and steam into a moulding chamber and the steam pressure has been sharply reduced from 4 atm abs to 1 atm abs. The following operations have been similar to those in Example 1. The physical and mechanical properties of the produced cardboard have been as follows: mass per 1 $m^2$–230 g; breaking length—2800 m; density—0.65 g/$cm^3$.

The above-described examples of manufacturing fibrous sheet materials from various raw materials show that the finished product has a sufficiently high tensile strength which allows the manufacturing process to be carried out at speeds exceeding 100 m/min. On the other hand, the manufacture of fibrous materials with this strenth makes it possible to dispense with the use of costly binders which cuts down considerably the price cost of the finished product.

The use of various wood fibres for the source material widens considerably the number of types of finished products.

What we claim is:

1. A method of manufacturing fibrous sheet materials from moist fibrous raw materials including the following operations: providing a suspension of fibrous material with a fiber concentration of 5–30 wt.-% in moist fibrous raw material; heating said suspension to 102°–145° C. under a pressure of 1.1–4.0 atm abs, delivering the heated suspension as a steam-air stream into a moulding chamber, reducing rapidly the pressure in the stream in the moulding chamber to 0.8–1.0 atm abs within a period of $10^{-1}$–$10^{-3}$ seconds to effect a rapid rate of dispersion of the fibers in a steam-air medium in the chamber with a simultaneous formation of an air-material mixture and uniform distribution of fibers sufficiently finely distributed in said mixture to alternatively make a sheet of cardboard or paper therefrom, moulding the fibers in the moulding chamber into a sheet of fibrous material free of binder material on a moving screen in the moulding chamber by settling the fibers from the air-material mixture under control of a pressure difference above and under the screen, compacting mechanically the settled fibrous sheet, and drying the sheet of fibrous material.

* * * * *